US011069300B2

(12) United States Patent
Bai et al.

(10) Patent No.: US 11,069,300 B2
(45) Date of Patent: Jul. 20, 2021

(54) DISPLAY DRIVING CIRCUIT, METHOD FOR DRIVING THE SAME, AND DISPLAY DEVICE

(71) Applicant: BOE TECHNOLOGY GROUP CO., LTD., Beijing (CN)

(72) Inventors: Xiao Bai, Beijing (CN); Shengji Yang, Beijing (CN); Weihai Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/817,575

(22) Filed: Mar. 12, 2020

(65) Prior Publication Data

US 2021/0134225 A1 May 6, 2021

(30) Foreign Application Priority Data

Oct. 30, 2019 (CN) ..... 201911051827.4

(51) Int. Cl.
*G09G 3/32* (2016.01)
*G09G 3/3266* (2016.01)

(52) U.S. Cl.
CPC ... *G09G 3/3266* (2013.01); *G09G 2310/0213* (2013.01); *G09G 2310/061* (2013.01); *G09G 2320/0261* (2013.01)

(58) Field of Classification Search
CPC ..... G09G 3/3266; G09G 3/3208; G09G 2310/0205; G09G 2310/0213;
(Continued)

(56) References Cited

U.S. PATENT DOCUMENTS 9,368,064 B2 6/2016 Toyomura et al.
9,607,548 B2 3/2017 Kimura et al.
(Continued)

FOREIGN PATENT DOCUMENTS

CN 103268753 A 8/2013
CN 103578424 A 2/2014
(Continued)

OTHER PUBLICATIONS

First Chinese Office Action dated Jul. 28, 2020, received for corresponding Chinese Application No. 201911051827.4, 17 pages.
(Continued)

*Primary Examiner* — Michael J Eurice
(74) *Attorney, Agent, or Firm* — Kinney & Lange, P.A.

(57) ABSTRACT

The embodiments of the present disclosure provide a display driving circuit, a method for driving the same, and a display device. The display driving circuit includes: a plurality of pixel driving sub-circuits, wherein each of the plurality of pixel driving sub-circuits is configured to drive a light-emitting device electrically coupled thereto. The plurality of pixel driving sub-circuits are divided into at least one group of pixel driving sub-circuits, each group of pixel driving sub-circuits is electrically coupled to receive the same scanning signal, and comprises at least two rows of pixel driving sub-circuits; and all the pixel driving sub-circuits in each group of pixel driving sub-circuits are electrically coupled to receive respective data signals, so that when any group of pixel driving sub-circuits is active under control of the scanning signal, respective data signals are written into the group of pixel driving sub-circuits simultaneously.

8 Claims, 5 Drawing Sheets

(58) Field of Classification Search
CPC ..... G09G 2310/0251; G09G 2310/061; G09G 2320/0247; G09G 2320/0261; G09G 2330/02; G09G 2330/021; H01L 27/32; H01L 51/50
See application file for complete search history.

(56) References Cited

U.S. PATENT DOCUMENTS

| | | | |
|---|---|---|---|
| 10,217,404 | B2 | 2/2019 | Kawada et al. |
| 10,679,554 | B2 | 6/2020 | Zhang et al. |
| 2014/0035798 | A1 | 2/2014 | Kawada et al. |
| 2014/0035965 | A1 | 2/2014 | Toyomura et al. |
| 2015/0187272 | A1 | 7/2015 | Kimura et al. |
| 2018/0130412 | A1 | 5/2018 | Zhang et al. |

FOREIGN PATENT DOCUMENTS

| | | | |
|---|---|---|---|
| CN | 103578425 | A | 2/2014 |
| CN | 104821150 | A | 8/2015 |
| CN | 108682366 | A | 10/2018 |
| CN | 109036279 | A | 12/2018 |
| JP | 2011123184 | A | 6/2011 |

OTHER PUBLICATIONS

First Chinese Office Action dated Feb. 3, 2021, received for corresponding Chinese Application No. 201911051827.4, 14 pages.

DISPLAY DRIVING CIRCUIT, METHOD FOR DRIVING THE SAME, AND DISPLAY DEVICE

CROSS-REFERENCE TO RELATED APPLICATION(S)

This application claims priority to the Chinese Patent Application No. 201911051827.4, filed on Oct. 30, 2019, which is incorporated herein by reference in its entirety.

TECHNICAL FIELD

The present disclosure generally relates to the field of display technology, and more particularly, to a display driving circuit, a method for driving the same, and a display device.

BACKGROUND

Organic Light-Emitting Devices (OLEDs) are widely used in the display field due to their characteristics such as lightness and thinness, high contrasts, wide operating temperature ranges etc.

In recent years, with the emergence of high-tech products such as Augmented Reality (AR)/Virtual Reality (VR) etc., the demand for silicon-based OLED micro-displays has continued to increase. In AR/VR display applications, motion blur issues may seriously affect the user experience.

SUMMARY

According to an aspect of the embodiments of the present disclosure, there is provided a display driving circuit for driving a plurality of light-emitting devices arranged in an array, the display driving circuit comprising:

a plurality of pixel driving sub-circuits, wherein each of the plurality of pixel driving sub-circuits is configured to drive a light-emitting device electrically coupled thereto, wherein the plurality of pixel driving sub-circuits are divided into at least one group of pixel driving sub-circuits, wherein each group of pixel driving sub-circuits among the at least one group of pixel driving sub-circuits is electrically coupled to receive the same scanning signal, and comprises at least two rows of pixel driving sub-circuits; and all the pixel driving sub-circuits in each group of pixel driving sub-circuits are electrically coupled to receive respective data signals, so that when any group of pixel driving sub-circuits is active under control of the scanning signal, respective data signals are written into the group of pixel driving sub-circuits simultaneously.

In an example, each group of pixel driving sub-circuits comprises two adjacent rows of pixel driving sub-circuits.

In an example, the display driving circuit further comprises a light-emitting control sub-circuit configured to receive a light-emitting control signal, and drive the plurality of light-emitting devices to emit light simultaneously under control of the light-emitting control signal.

In an example, the light-emitting control sub-circuit comprises a light-emitting control transistor having a gate configured to receive the light-emitting control signal, a first electrode electrically coupled to a first power supply voltage, and a second electrode electrically coupled to the plurality of pixel driving sub-circuits.

In an example, each of the plurality of pixel driving sub-circuits comprises a driving transistor, an energy storage capacitor, a writing sub-circuit, and a reset sub-circuit, wherein the driving transistor has a gate electrically coupled to the writing sub-circuit, a first electrode electrically coupled to the light-emitting control sub-circuit, and a second electrode electrically coupled to a first terminal of one light-emitting device of the plurality of light-emitting devices;

the energy storage capacitor has a first terminal electrically coupled to the writing sub-circuit, and a second terminal electrically coupled to a second power supply voltage, the writing sub-circuit is coupled to receive the scanning signal and a corresponding data signal, and the reset sub-circuit is coupled to receive a reset signal and is configured to reset the light-emitting device under control of the reset signal.

In an example, the writing sub-circuit comprises a writing control transistor having a gate configured to receive the scanning signal, a first electrode configured to receive the data signal, and a second electrode electrically coupled to the first terminal of the energy storage capacitor.

In an example, the reset sub-circuit comprises a reset control transistor having a gate coupled to receive the reset signal, a first electrode electrically coupled to a first electrode of the light-emitting device, and a second electrode electrically coupled to the second power supply voltage.

According to another aspect of the embodiments of the present disclosure, there is provided a display device comprising the display driving circuit according to various embodiments of the present disclosure.

According to yet another aspect of the embodiments of the present disclosure, there is provided a method for driving the display driving circuit according to various embodiments of the present disclosure, comprising:

driving, during a writing phase, respective groups of pixel driving sub-circuits to be active sequentially under control of a scanning signal, and writing respective data signals into the active pixel driving sub-circuits simultaneously; and driving, during a light-emitting phase, by the plurality of pixel driving sub-circuits, the plurality of light-emitting devices to emit light simultaneously under control of a light-emitting control signal.

BRIEF DESCRIPTION OF THE ACCOMPANYING DRAWINGS

Other features, purposes, and advantages of the present disclosure will become more apparent by reading the detailed description of the non-limiting embodiments made with reference to the following accompanying drawings.

DETAILED DESCRIPTION

The present disclosure will be further described in detail below with reference to the accompanying drawings and the embodiments. It may be understood that specific embodiments described here are only used to explain the related disclosure, rather than limiting the present disclosure. It should also be illustrated that, for convenience of description, only parts related to the present disclosure are shown in the accompanying drawings.

Unless otherwise defined, technical terms or scientific terms used in the present disclosure should be interpreted in the ordinary sense for those of ordinary skill in the art to which the present disclosure belongs. The words such as "first," "second," etc. used in the present disclosure do not mean any order, quantity or importance, but merely serve to distinguish different constituent parts. The word such as "including" or "comprising" etc. means that an element or item preceding the word covers elements or items which appear after the word and their equivalents, but does not exclude other elements or items. The word "electrically coupled" or "coupled" etc. is not limited to physical or mechanical coupling but may comprise electrical coupling, regardless of direct connections or indirect connections. "Upper", "lower", "left", "right", etc. are only used to indicate a relative positional relationship, and after an absolute position of an object which is described changes, the relative positional relationship may also change accordingly.

It should be illustrated that the embodiments in the present disclosure and the features in the embodiments may be combined with each other without conflict. The present disclosure will be described in detail below with reference to the accompanying drawings in combination with the embodiments.

One way to improve motion blur is to use "black insertion". One way to achieve black insertion is that after data of the entire frame of picture is completely written, all pixels emit light simultaneously, so that black insertion is achieved by controlling a light-emitting time. In this way, an adjustable range of a black insertion ratio is limited by a refresh frequency, an Integrated Circuit (IC) response time, a data writing time etc., which may easily cause defects such as flicker etc. With the development of OLED displays, the refresh frequency is constantly increasing, and the adjustable range of the black insertion ratio is becoming smaller and smaller, which has become an urgent technical problem.

Figure 1:
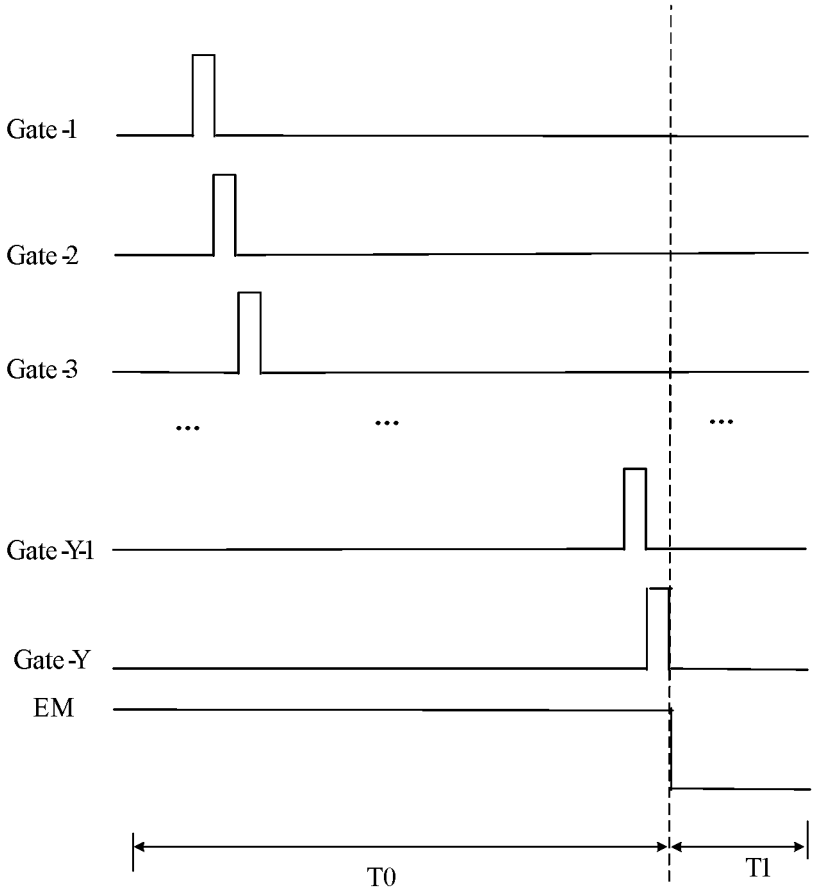
FIG. 1 illustrates an exemplary operation timing diagram of a display driving circuit.

FIG. 1 illustrates a timing diagram of controlling display driving of a row of pixel driving sub-circuits using one scanning signal. As shown in FIG. 1, a display time period of one frame of image comprises a data writing time period T0 and a light-emitting time period T1. In a case of a given refresh frequency, a display time of each frame of image is given, wherein a data writing time T0 accounts for a relatively large amount of the display time, and a display light-emitting time T1 accounts for a relatively small amount of the display time, which causes the black insertion ratio to have a very narrow adjustable range, and a relatively low black insertion ratio is likely to cause poor display such as motion blur etc. Here, for a display device such as an OLED, the black insertion ratio refers to a percentage of a light-emitting time of one frame of picture with respect to a display time of the frame of picture, that is, T1/(T0+T1) *100%.

Figure 2:
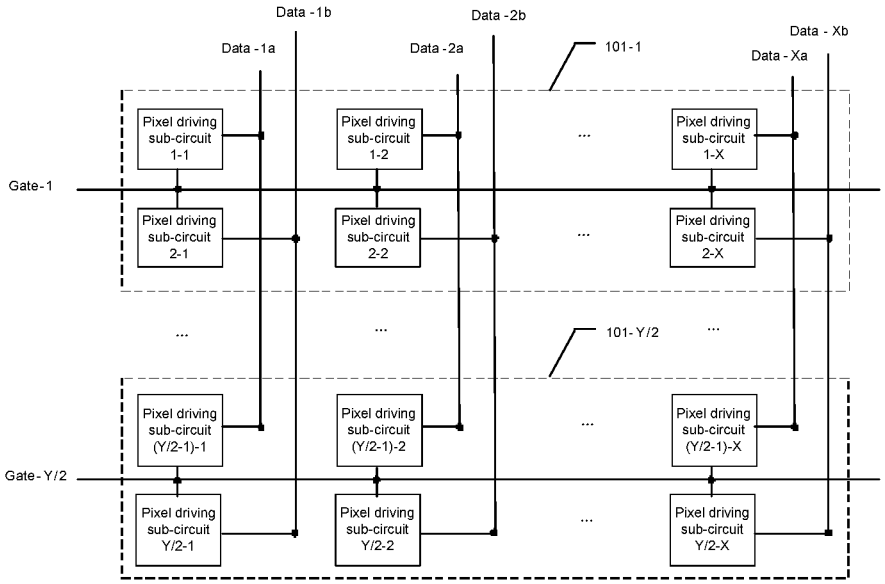
FIG. 2 illustrates an exemplary structural block diagram of a display driving circuit according to an embodiment of the present disclosure.

FIG. 2 illustrates a structural block diagram of a display driving circuit according to an embodiment of the present disclosure. The display driving circuit is used to drive light-emitting devices arranged in an array. As shown in FIG. 2, the display driving circuit comprises a plurality of pixel driving sub-circuits 1_1, . . . , and Y/2_X, and each of the plurality of pixel driving sub-circuits is configured to drive a light-emitting device electrically coupled thereto.

The plurality of pixel driving sub-circuits are divided into at least one group of pixel driving sub-circuits, wherein one group of pixel driving sub-circuits 101 among the at least one group of pixel driving sub-circuits receives a scanning signal Gate. The group of pixel driving sub-circuits 101 is active under control of the scanning signal Gate. Each group of pixel driving sub-circuits comprises at least two rows of pixel driving sub-circuits.

All the pixel driving sub-circuits in each group of pixel driving sub-circuits receive respective data signal Data. When any group of pixel driving sub-circuits 101 is active, respective data signals Data are written into the group of pixel driving sub-circuits simultaneously. It should be illustrated that "the pixel driving sub-circuit is active" means that the pixel driving sub-circuit is in a state in which a data signal may be received. Details may be known with reference to description of FIG. 3 and FIG. 5.

For example, as shown in FIG. 2, every two rows of pixel driving sub-circuits are grouped, and each group of pixel driving sub-circuits 101 receives a corresponding scanning signal. For example, a first group of pixel driving sub-circuits 101_1 receives a first scanning signal Gate1, and so on . . . , and a last group of pixel driving sub-circuits 101_Y/2 receives a scanning signal Gate_Y/2. All the pixel driving sub-circuits in each group of pixel driving sub-circuits receive respective data signals, for example, a pixel driving sub-circuit 1_1 is electrically coupled to receive a data signal Data_1*a*, a pixel driving sub-circuit 2_1 is electrically coupled to receive a data signal Data_1*b*, a pixel driving sub-circuit 1_2 is electrically coupled to receive a data signal Data_2*a*, a pixel driving sub-circuit 2_2 is electrically coupled to receive a data signal Data_2*b*, and so on . . . , and a pixel driving sub-circuit 1_X and a pixel driving sub-circuit 2_X receive a data signal Data_Xa and a data signal Data_Xb respectively. At this time, when the scanning signal Gate_1 is at an active level, the pixel driving sub-circuits 1_1 to 2_X in the first group of pixel driving sub-circuits 101_1 simultaneously receive the data signals Data_1*a* to Data-_Xb respectively. Thereby, data signals are written into two rows of pixel driving sub-circuits during a time period during which one scanning signal is active. Compared with writing data signals into a row of pixel driving sub-circuits in response to each scanning signal at an active level, in the present disclosure, in a case of the same refresh frequency, IC response time, and data writing time, the writing time of one frame of image may be reduced by one half, and a number of scanning signals used is also reduced by one half, thereby simplifying the complexity of the GOA circuit for providing the scanning signals.

It may be understood that, for the display driving circuit of FIG. 2, the pixel driving sub-circuits therein may have various structures, which is not limited here. The above description is only related to an example in which each group of pixel driving sub-circuits comprises two rows of pixel driving sub-circuits, and in practical applications, each group of pixel driving sub-circuits may comprise any number of rows of pixel driving sub-circuits, which will not be described by way of example here.

Figure 3:
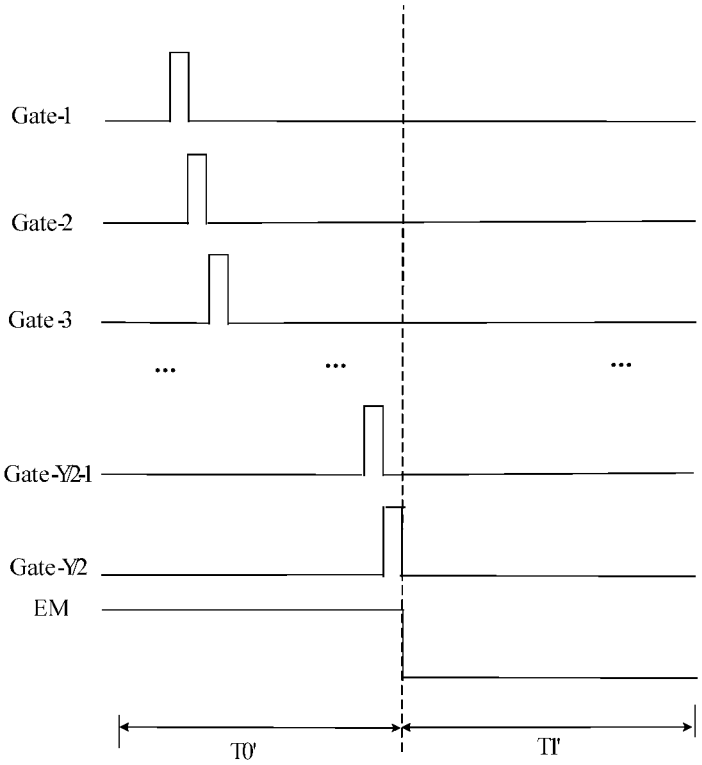
FIG. 3 illustrates an exemplary operation timing diagram of the display driving circuit of FIG. 2 according to an embodiment of the present disclosure.

FIG. 3 illustrates an exemplary operation timing diagram of the display driving circuit of FIG. 2. As shown in FIG. 3, a display time period of one frame of image may comprise a data writing time period T0' and a light-emitting time period T1'. Compared with the example of FIG. 1, since one scanning signal controls two rows of pixel driving sub-circuits in FIG. 2, a number of scanning signals is reduced from Gate_Y to Gate_Y/2. In a case of the same refresh frequency, IC response time, and data writing time, the data writing time T0' in FIG. 3 is a half of the writing time T0 in FIG. 2, and the display light-emitting time T1' has a wider range, so that the black insertion ratio has a wider adjustable range. A higher black insertion ratio is beneficial to improving poor display such as motion blur etc. For example, the scanning signal Gate_1, . . . , and the scanning signal Gate_Y/2 control the respective pixel driving sub-circuits 101_1, . . . , and the pixel driving sub-circuits 101_Y/2. When the pixel driving sub-circuits 101_1 receive a high level (active level) pulse signal of the scanning signal Gate_1, respective data signals are written into the pixel driving sub-circuits 101_1. Then, the scanning signal Gate_2 and the scanning signal Gate_3 are, for example, at an active level such as a high level sequentially, until the pixel driving sub-circuits 101_Y/2 receive a high level pulse signal of the scanning signal Gate_Y/2, to complete the scanning of one frame. In the present embodiment, during a time period during which the scanning signal is at a high level, data signals are written into the respective pixel driving sub-circuits.

Figure 4:
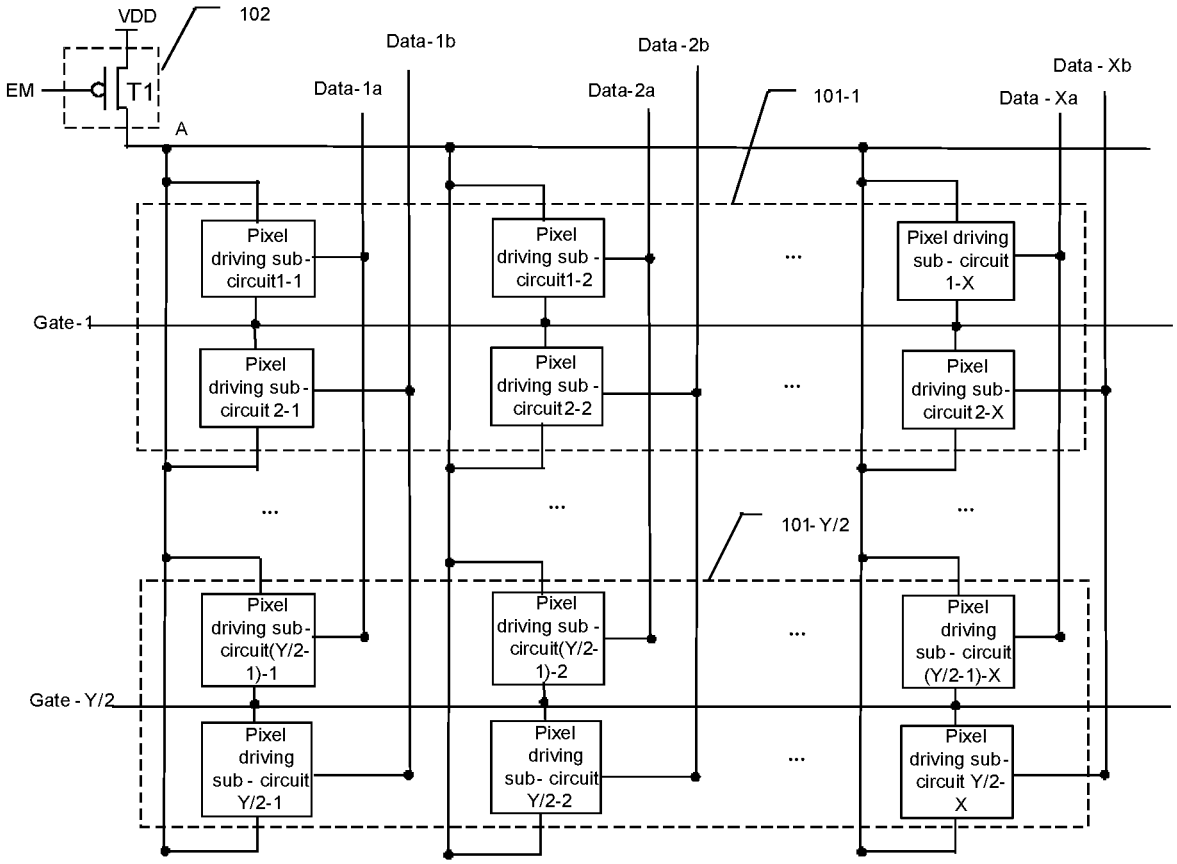
FIG. 4 illustrates an exemplary structural block diagram of a display driving circuit according to another embodiment of the present disclosure.

As shown in FIG. 4, illustrated is a structure of another display driving circuit. Compared with the display driving circuit shown in FIG. 2, the display driving circuit shown in FIG. 4 further comprises a light-emitting control sub-circuit 102 electrically coupled to receive a light-emitting control signal EM. All the light-emitting devices in the display driving circuit are driven to emit light simultaneously under control of the light-emitting control signal EM.

In one example, there may be a light-emitting control sub-circuit disposed in each of the pixel driving sub-circuits, which not only causes a waste of resources, but also increases the complexity of the circuit. The present disclosure provides a circuit structure in which the entire display driving circuit shares one light-emitting control sub-circuit to drive the light-emitting devices to emit light.

As shown in FIG. 4, the light-emitting control sub-circuit may comprise a light-emitting control transistor T1 having a gate configured to receive the light-emitting signal EM, a first electrode electrically coupled to a first power source voltage VDD, and a second electrode electrically coupled to the respective pixel driving sub-circuits.

In the present disclosure, the light emission of all the pixel circuits is controlled by an external light-emitting control sub-circuit, which as compared with providing the pixel driving sub-circuits with respective control circuits for light-emitting signals thereof, may reduce the cost and the complexity of the circuit, and realize overall control of the light emission.

Figure 5:
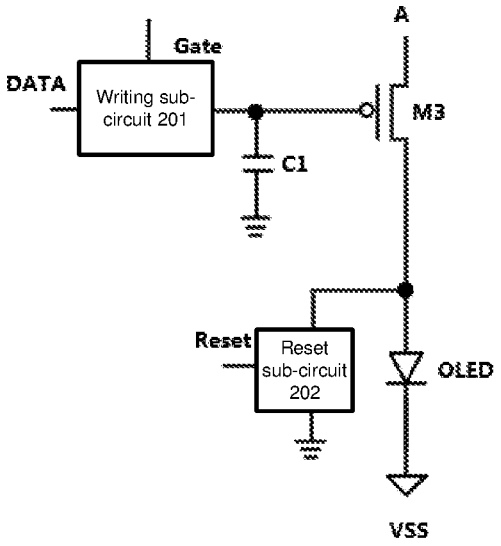
FIG. 5 illustrates an exemplary structural block diagram of the pixel driving sub-circuit of FIG. 4 according to the present disclosure.

FIG. 5 illustrates an exemplary block diagram of a pixel driving sub-circuit. As shown in FIG. 5, the pixel driving sub-circuit may comprise a driving transistor M3, an energy storage capacitor C1, a writing sub-circuit 201, and a reset sub-circuit 202.

The driving transistor M3 has a gate electrically coupled to the writing sub-circuit 201, a first electrode electrically coupled to a second electrode of a light-emitting transistor, and a second electrode electrically coupled to a light-emitting device OLED.

The energy storage capacitor C1 has a first terminal electrically coupled to the writing sub-circuit 201, and a second terminal electrically coupled to a second power supply voltage terminal. For example, the second power supply voltage terminal may be a ground terminal.

The writing sub-circuit 201 is coupled to receive a scanning signal Gate and a data signal Data, wherein the data signal Data is received when the scanning signal Gate is at an active level.

The reset sub-circuit 202 may receive a reset signal Reset and reset the light-emitting device under control of the reset signal Reset.

When the scanning signal Gate is at an active level, the writing sub-circuit 201 receives the data signal Data and stores the data signal Data in the energy storage capacitor C1. When a light-emitting signal EM is at an active level, the driving transistor M3 is turned on to drive the light-emitting device OLED to emit light. Further, before a next scanning signal Gate is at an active level, the light-emitting device OLED is reset through a reset signal at an active level, for example, charges at a first terminal (for example, an anode) of the light-emitting device OLED are discharged. The scanning signal being active means that the scanning signal enables the coupled pixel driving sub-circuit to receive a data signal. For example, the scanning signal may be a high level pulse signal or a low level pulse signal, and the scanning signal may be at a high level or a low level.

Figure 6:
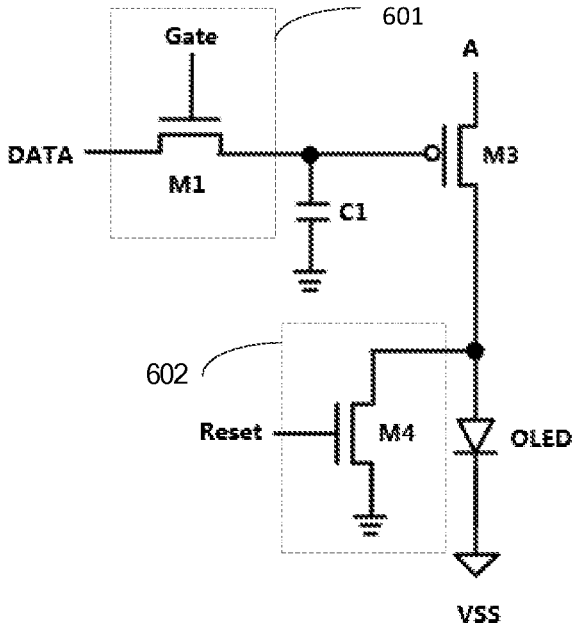
FIG. 6 illustrates an exemplary schematic diagram of the pixel driving sub-circuit of FIG. 4.

As shown in FIG. 6, the writing sub-circuit 601 may comprise a writing transistor M1 having a gate electrically coupled to receive the scanning signal Gate, a first electrode electrically coupled to receive the data signal Data, and a second electrode electrically coupled to the first terminal of the energy storage capacitor C1. When the scanning signal Gate is at an active level, in an example in which the writing transistor M1 is an N-type transistor, the scanning signal Gate is active when it is at a high level. At this time, the writing transistor M1 is turned on, so that the data signal Data is applied to the gate of the driving transistor M3. At this time, it may be considered that the pixel driving sub-circuit is active. It may be understood by those skilled in the art that the active level of the scanning signal Gate may be a high level pulse signal or a low level pulse signal, which is determined according to a type of the writing transistor.

The reset sub-circuit 602 may comprise a reset transistor M4. The reset transistor M4 has a gate configured to receive the reset signal Reset, a first electrode electrically coupled to the first electrode (for example, the anode) of the light-emitting device OLED, and a second electrode configured to be grounded.

Figure 7:
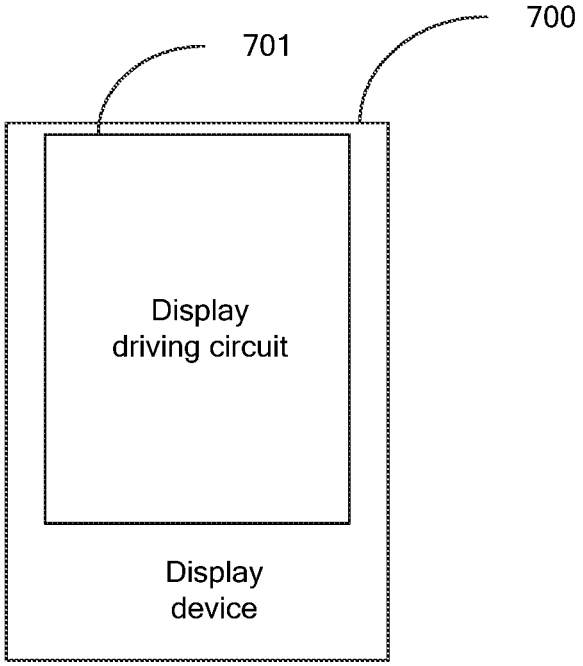
FIG. 7 illustrates a block diagram of a display device according to an embodiment of the present disclosure.

The present disclosure further discloses a display device. As shown in FIG. 7, the display device 700 may comprise a display driving circuit 701 according to various embodiments of the present disclosure.

Figure 8:
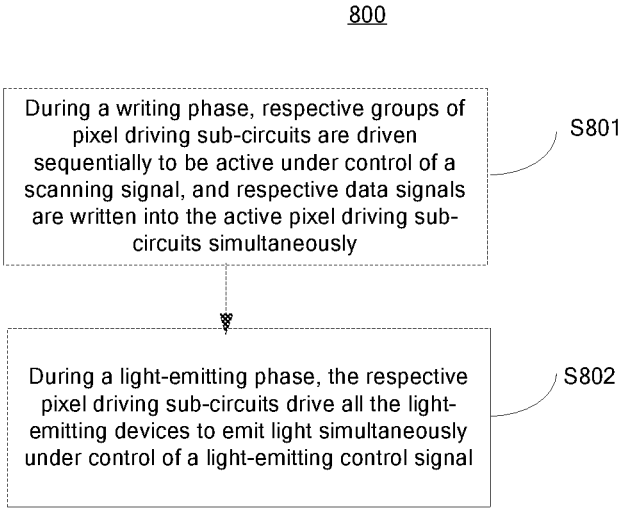
FIG. 8 illustrates a flowchart of a driving method according to an embodiment of the present disclosure.

In addition, the embodiments of the present disclosure further provide a driving method for driving the display driving circuit according to the embodiments of the present disclosure. FIG. 8 illustrates a flowchart of a driving method according to an embodiment of the present disclosure. As shown in FIG. 8, the driving method 800 according to the embodiment of the present disclosure may comprise the following steps.

In step S801, during a writing phase, respective groups of pixel driving sub-circuits are driven sequentially to be active under control of a scanning signal, and respective data signals are written into the active pixel driving sub-circuits simultaneously.

In step S802, during a light-emitting phase, the respective pixel driving sub-circuits drive all the light-emitting devices to emit light simultaneously under control of a light-emitting control signal.

Description will be made below with reference to FIGS. 3 and 4. The display driving circuit shown in FIG. 4 may comprise Y rows and X columns of pixel driving sub-circuits, and all the pixel driving sub-circuit correspond to respective light-emitting devices in one-to-one correspondence. Each scanning signal is electrically coupled to two rows of pixel driving sub-circuits, for example, the scanning signal Gate_1 is electrically coupled to the first group of pixel driving sub-circuits 101_1, and the scanning signal Gate_Y/2 is electrically coupled to the last group of pixel driving sub-circuits 101_Y/2. When, for example, the scanning signal Gate_1 is at an active level, the data signals Data_1*a* to Data_Xb are written into the first group of pixel driving sub-circuits 101_1, and so on . . . , to write data signals into each group of pixel driving sub-circuits, until when the scanning signal Gate_Y/2 is active, the data signals Data_1*a* to Data_Xb are written into the last group of pixel driving sub-circuits 101_Y/2. Data signals of one frame are written into the respective pixel driving sub-circuits in the above process. This phase is a phase T0' in FIG. 3.

Then, the respective pixel driving sub-circuits are controlled through the active light-emitting signal EM to drive the light-emitting devices to emit light simultaneously. The above phase is a light-emitting phase T1' in FIG. 3.

The above description is only explanation of preferred embodiments of the present disclosure and the applied technical principles. It should be understood by those skilled in the art that the scope of the present disclosure involved in present disclosure is not limited to technical solutions formed by specifically combining the above technical features, but also should cover other technical solutions formed by combining the above technical features or other equivalent features in any manner without departing from the concept of the present disclosure, for example, technical solutions formed by substituting the above technical features with technical features disclosed in the present disclosure which are not limited to technical features having similar functions.

We claim:

1. A display driving circuit for driving a plurality of light-emitting devices arranged in an array, the display driving circuit comprising:

a plurality of pixel driving sub-circuits, wherein each of the plurality of pixel driving sub-circuits is configured to drive a light-emitting device electrically coupled thereto, wherein the plurality of pixel driving sub-circuits are divided into at least one group of pixel driving sub-circuits, wherein:

each group of pixel driving sub-circuits among the at least one group of pixel driving sub-circuits is electrically coupled to receive the same scanning signal, and comprises at least two rows of pixel driving sub-circuits; and all the pixel driving sub-circuits in each group of pixel driving sub-circuits are electrically coupled to receive respective data signals, so that when any group of pixel driving sub-circuits is active under control of the scanning signal, respective data signals are written into the group of pixel driving sub-circuits simultaneously;

wherein the display driving circuit further comprises a light-emitting control sub-circuit configured to receive a light-emitting control signal, and drive all of the plurality of light-emitting devices to emit light simultaneously under control of the light-emitting control signal.

2. The display driving circuit according to claim 1, wherein each group of pixel driving sub-circuits comprises two adjacent rows of pixel driving sub-circuits.

3. The display driving circuit according to claim 1, wherein the light-emitting control sub-circuit comprises a light-emitting control transistor having a gate configured to receive the light-emitting control signal, a first electrode electrically coupled to a first power supply voltage, and a second electrode electrically coupled to the plurality of pixel driving sub-circuits.

4. A display device comprising the display driving circuit according to claim 1.

5. A method for driving the display driving circuit according to claim 1, comprising:

driving, during a writing phase, respective groups of pixel driving sub-circuits to be active sequentially under control of a scanning signal, and writing respective data signals into the active pixel driving sub-circuits simultaneously; and driving, during a light-emitting phase, by the plurality of pixel driving sub-circuits, the plurality of light-emitting devices to emit light simultaneously under control of a light-emitting control signal.

6. The display driving circuit according to claim 1, wherein each of the plurality of pixel driving sub-circuits comprises a driving transistor, an energy storage capacitor, a writing sub-circuit, and a reset sub-circuit, wherein:

the driving transistor has a gate electrically coupled to the writing sub-circuit, a first electrode electrically coupled to the light-emitting control sub-circuit, and a second electrode electrically coupled to a first terminal of one light-emitting device of the plurality of light-emitting devices;

the energy storage capacitor has a first terminal electrically coupled to the writing sub-circuit, and a second terminal electrically coupled to a second power supply voltage;

the writing sub-circuit is coupled to receive the scanning signal and a corresponding data signal; and the reset sub-circuit is coupled to receive a reset signal and is configured to reset the light-emitting device under control of the reset signal.

7. The display driving circuit according to claim 6, wherein:

the writing sub-circuit comprises a writing control transistor having a gate configured to receive the scanning signal, a first electrode configured to receive the data signal, and a second electrode electrically coupled to the first terminal of the energy storage capacitor.

8. The display driving circuit according to claim 6, wherein:

the reset sub-circuit comprises a reset control transistor having a gate coupled to receive the reset signal, a first electrode electrically coupled to a first electrode of the light-emitting device, and a second electrode electrically coupled to the second power supply voltage.

* * * * *